US006438794B2

(12) United States Patent
Ng et al.

(10) Patent No.: US 6,438,794 B2
(45) Date of Patent: Aug. 27, 2002

(54) RELEASABLE AUTOMOTIVE DOOR STOP

(75) Inventors: Billy Chean Wang Ng, New Market; Rudolf Gruber, Uxbridge, both of (CA); David H. Grandinett, Livonia, MI (US)

(73) Assignees: Multimatic, Inc., Markham (CA); Ford Motor Company, Dearborne, MI (US)

( * ) Notice: Subject to any disclaimer, the term of this patent is extended or adjusted under 35 U.S.C. 154(b) by 0 days.

(21) Appl. No.: 09/782,203

(22) Filed: Feb. 14, 2001

(30) Foreign Application Priority Data

Feb. 15, 2000 (CA) ..... 2298853

(51) Int. Cl.[7] ..... E05F 5/02
(52) U.S. Cl. ..... 16/82; 16/86 C
(58) Field of Search ..... 16/82, 86 B, 86 C, 16/371, 374, 375, 292; 292/262, 265–278

(56) References Cited

U.S. PATENT DOCUMENTS 4,663,801 A * 5/1987 Malopolski, Jr. ..... 16/292
4,833,755 A * 5/1989 Bonin ..... 16/344
5,152,030 A * 10/1992 Cogo ..... 16/344
5,173,991 A * 12/1992 Carswell ..... 16/325
5,444,894 A * 8/1995 Heiler ..... 16/257
5,474,344 A * 12/1995 Lee ..... 16/86 C
5,862,570 A * 1/1999 Lezuch et al. ..... 16/82
6,145,163 A * 11/2000 Mitchell et al. ..... 16/82
6,178,594 B1 * 1/2001 Koch ..... 16/374

* cited by examiner

*Primary Examiner*—Chuck Y. Mah
(74) *Attorney, Agent, or Firm*—Kramer & Associates, P.C.

(57) ABSTRACT

A door checking and stopping apparatus for an automotive cargo door comprises a housing containing an energy storage device and guidance arrangement adapted to be rigidly mounted to a vehicular door, an arm containing a cam profile with detent positions, permanently pivotally connection to the body structure of the vehicle and configured to interface with the guidance arrangement in the housing, a striker device adapted to be rigidly mounted to a resilient member that is configured to constrain the striker from translational motion parallel to the arm centreline but to facilitate translational motion perpendicular to the arm centreline, a hook feature incorporated into the free end of the arm that is adapted to interlock with the striker, such that the resilient member biases the striker into engagement with the hook feature when the door reaches its predetermined intermediate stop position, providing adequate motion resistance until it is disengaged by simply forcing the resilient member so that the striker disengages the hook feature.

14 Claims, 5 Drawing Sheets

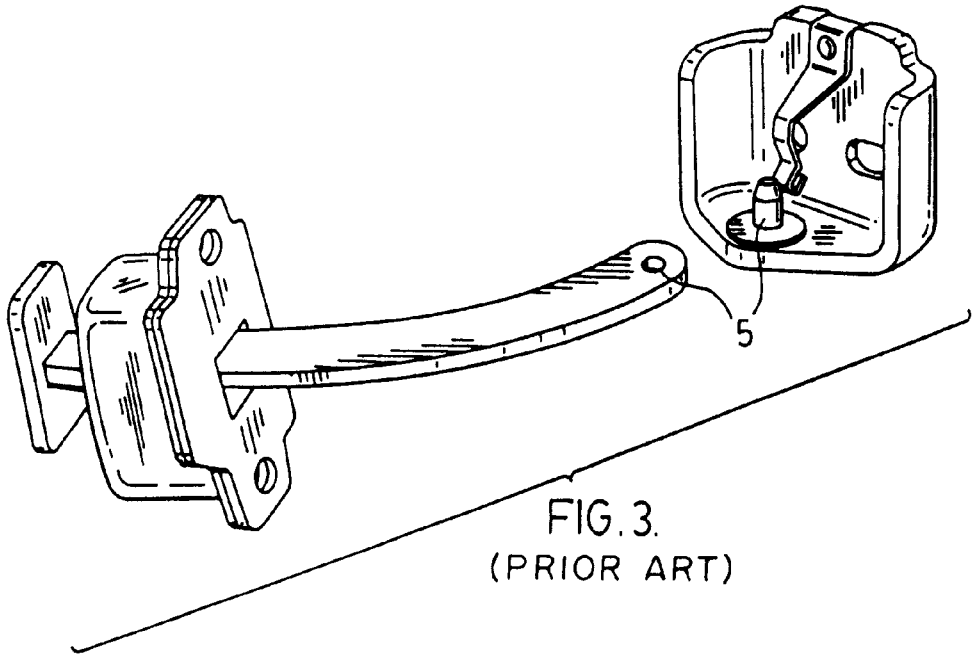
FIG. 3.
(PRIOR ART)
(PRIOR ART)
FIG. 4.
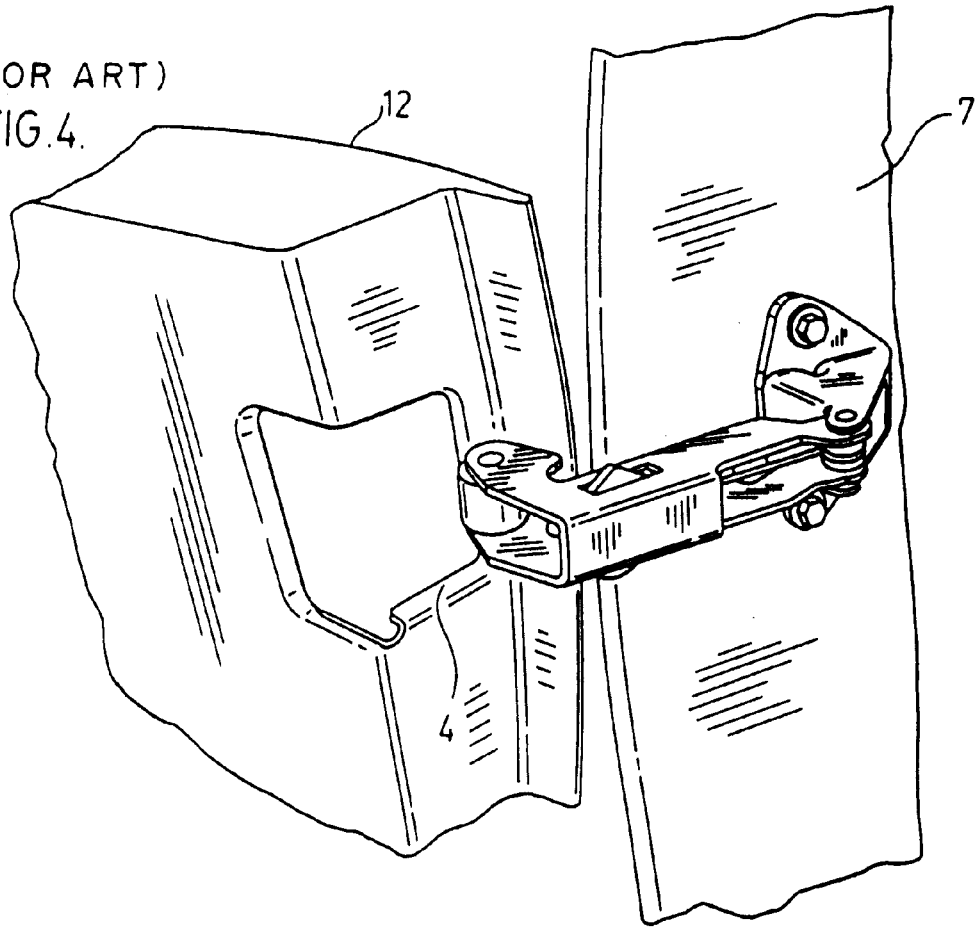

RELEASABLE AUTOMOTIVE DOOR STOP

FIELD OF THE INVENTION

This invention relates to a mechanical device capable of positively stopping an automotive door from rotation at a predetermined position and then facilitating simple single-handed release to allow further rotation when desired.

BACKGROUND TO THE INVENTION

Commercial vans utilize cargo loading doors that are required to open to higher angles than other automotive closure panels. These doors are regularly configured with a motion range of 180 degrees and in some cases up to 270 degrees in comparison to standard automotive passenger doors, which utilizes no more than 90 degrees of rotation. As with other automotive closure applications, it is desirable to check the door at a number of predetermined open positions with a predetermined force to assure convenient and safe ingress/egress of the occupants and cargo. The door is normally checked against movement in at least one open position with an effort adequate to resist wind gusts and the effect of parking on a grade. Additionally, it has been found useful and in some countries it is legislated, to constrain an automotive cargo door against rotation with a solid stop at a predetermined angle. This intermediate constraint is usually placed at 90 degrees and is configured so that the door cannot over swing the stop condition by imparting operator generated loads. This solid intermediate stop is in contrast to a check condition, which can be overcome by exceeding a predetermined force. The intermediate stop is then configured with some manual method of defeat so that the cargo door can swing through its remaining range of motion to its full open stop.

Referring to FIGS. 1 to 4, the most common form of automotive door check is a mechanical device that resists motion via releasably storing energy in response to forced motion of the system. In cargo van applications the most common configuration of door check is as an autonomous mechanical assembly, separate from the door hinge. This device usually consists of a door or body mounted housing (1) containing some form of energy storage device such as an elastomer spring and an arm (2) that contains a cam profile with detent positions that dictate the check positions and forces. The full open door stop is normally configured to be incorporated into the hinge assembly while the intermediate stop is normally contained in the door check device. This intermediate stop usually consists of a plate (3) attached to the end of the door check arm (2) that constrains it from movement against the housing (1). There is a wide range of intermediate stop defeat methods but the most common is some form of manual disconnect of the arm from the door mounted housing (4) or pivot end (5). This type of manual disconnection is awkward and in many cases relies on the operator to reconnect when the door is being closed. Some systems do facilitate automatic reconnection but still require two hands to operate the defeat, are complex and susceptible to corrosion and wear and can prove dangerous to the operator as they normally contain numerous pinch points.

SUMMARY OF THE INVENTION

The present invention is targeted at simplifying the operation of defeating and activating an automotive cargo door intermediate stop. It specifically packages the intermediate stop in an autonomous door check assembly and provides a mechanism that facilitates simple one finger disconnection and automatic reconnection.

In a principal aspect of the invention, a door checking and stopping apparatus for an automotive cargo door comprises: a housing containing an energy storage device and guidance arrangement adapted to be rigidly mounted to a vehicular door; an arm containing a cam profile with detent positions, permanently pivotally connected to the body structure of the vehicle and configured to interface with the guidance arrangement in the housing; a striker device adapted to be rigidly mounted to a resilient member that is configured to constrain the striker from translational motion parallel to the arm centreline but to facilitate translational motion perpendicular to the arm centreline; a hook feature incorporated into the free end of the arm that is adapted to interlock with the striker; such that the resilient member biases the striker into engagement with the hook feature when the door reaches its predetermined intermediate stop position, providing adequate motion resistance until it is disengaged by simply forcing the resilient member so that the striker disengages the hook feature.

In further aspects of the door checking and stopping apparatus invention:

(a) the resilient member is adapted to be rigidly mounted to the housing creating a single assembly of housing, resilient member and striker;

(b) the resilient member is provided with a tab feature that interfaces with a sliding pin and bushing assembly, adapted to be mounted to the vehicular door structure, facilitating simple actuation of the striker defeat;

(c) the resilient member is provided with an attachment to a cable that is terminated externally to the door facilitating simple actuation of the striker defeat;

(d) the resilient member is manufactured from a high strength spring steel;

(e) the resilient member is manufactured from high strength composite material such as carbon fibre.

BRIEF DESCRIPTION OF THE DRAWINGS

FIG. 3 is a perspective view of a typical prior art door check with its arm disconnected at the arm pivot;

FIG. 4 is a perspective view of a typical prior art door check with its arm disconnected from the housing;

DETAILED DESCRIPTION OF THE INVENTION

Figure 1:
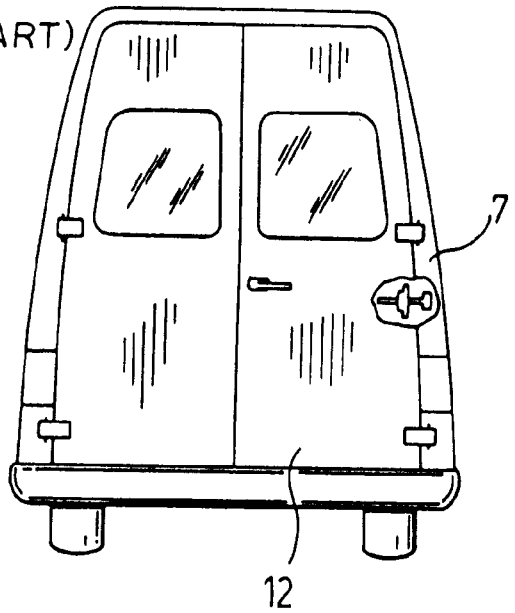
FIG.1. (PRIOR ART)
FIG. 1 is a break away perspective view of a typical automotive cargo door hinge and check installation.
Figure 2:
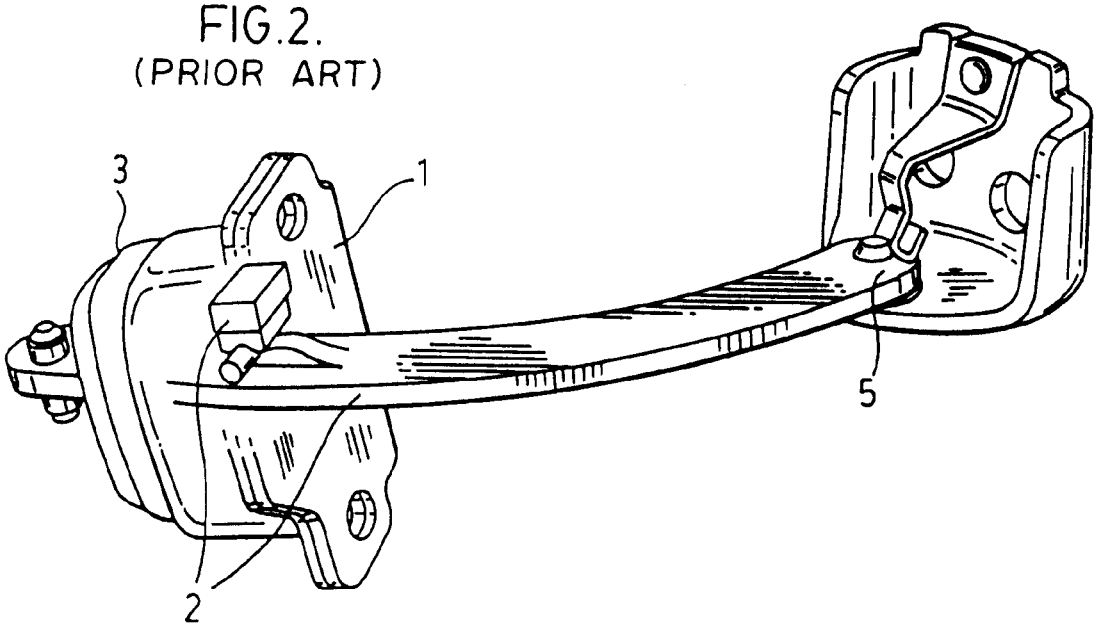
FIG.2. (PRIOR ART)
FIG. 2 is a break away perspective view of a typical prior art door check.
Figure 5:
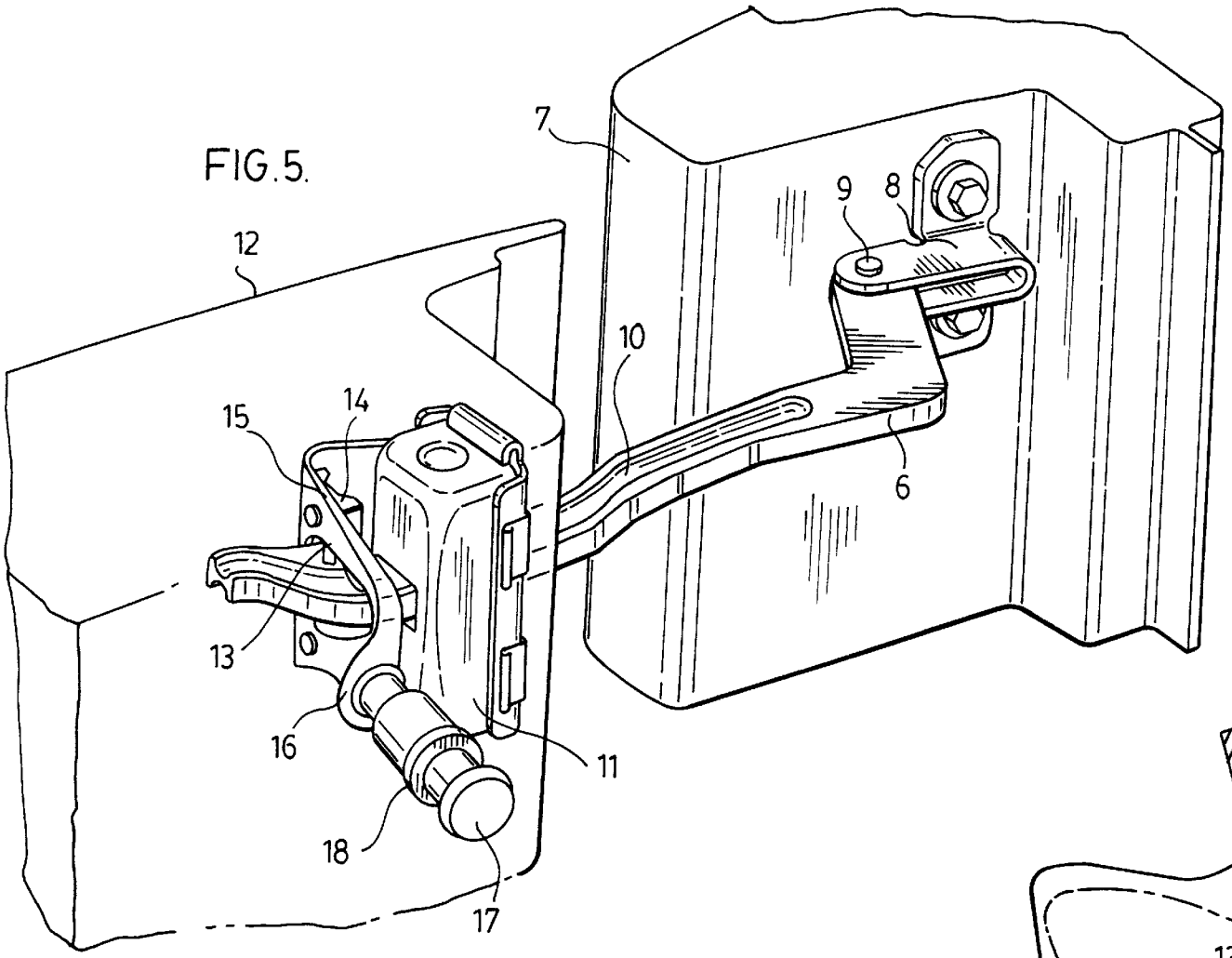
FIG. 5 is a perspective view showing the components of the inventive check assembly.
Figure 6:
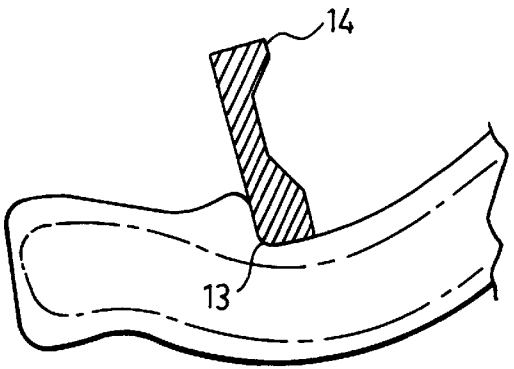
FIG. 6 is a close up view showing the striker and hook feature of the inventive check assembly.
Figure 7:
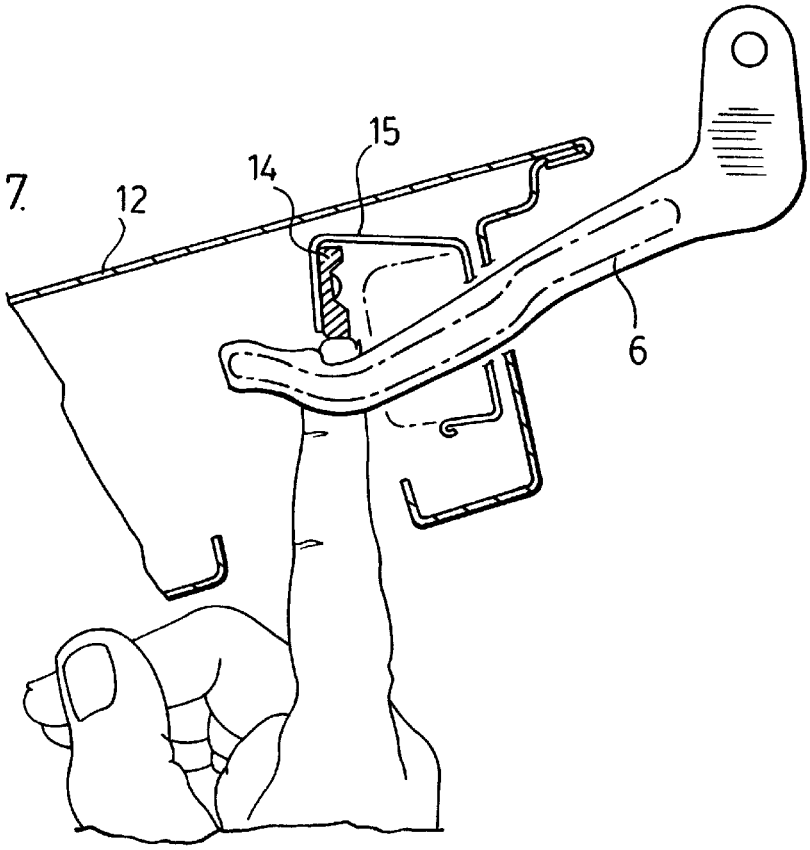
FIG. 7 is a sectional view of the inventive check assembly in the stop-released position.
Figure 8:
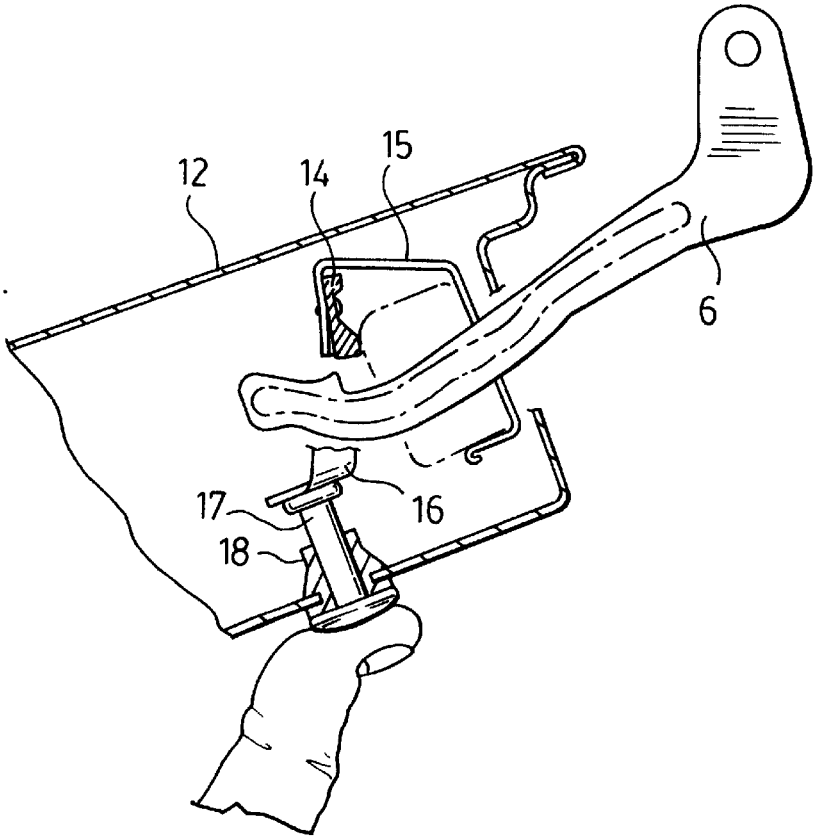
FIG. 8 is a sectional view of the inventive check assembly in the stop-released position incorporating a tab feature and sliding pin.
Figure 9:
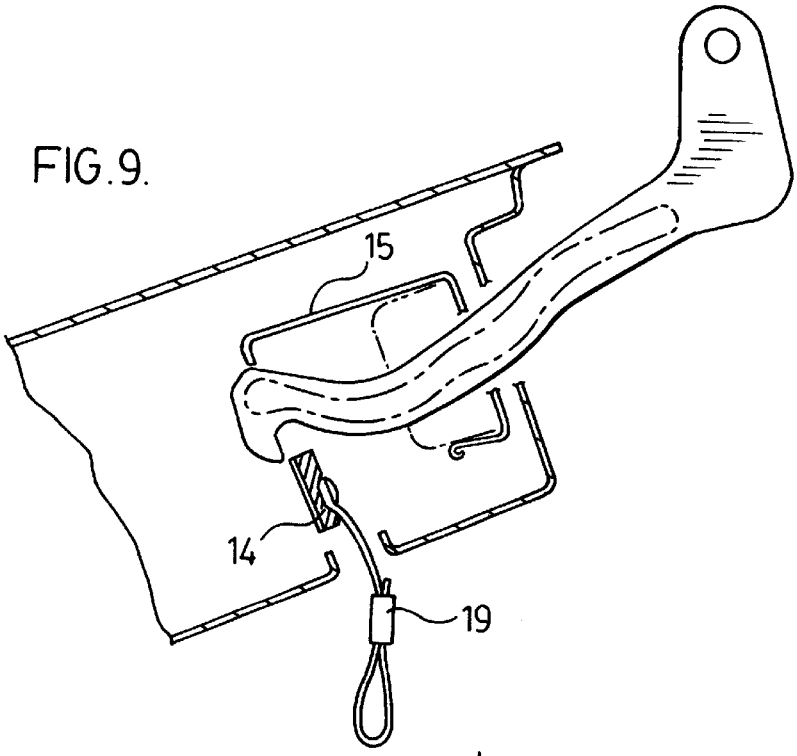
FIG. 9 is a sectional view of the inventive check assembly in the stop-released position incorporating a release cable.
Figure 10:
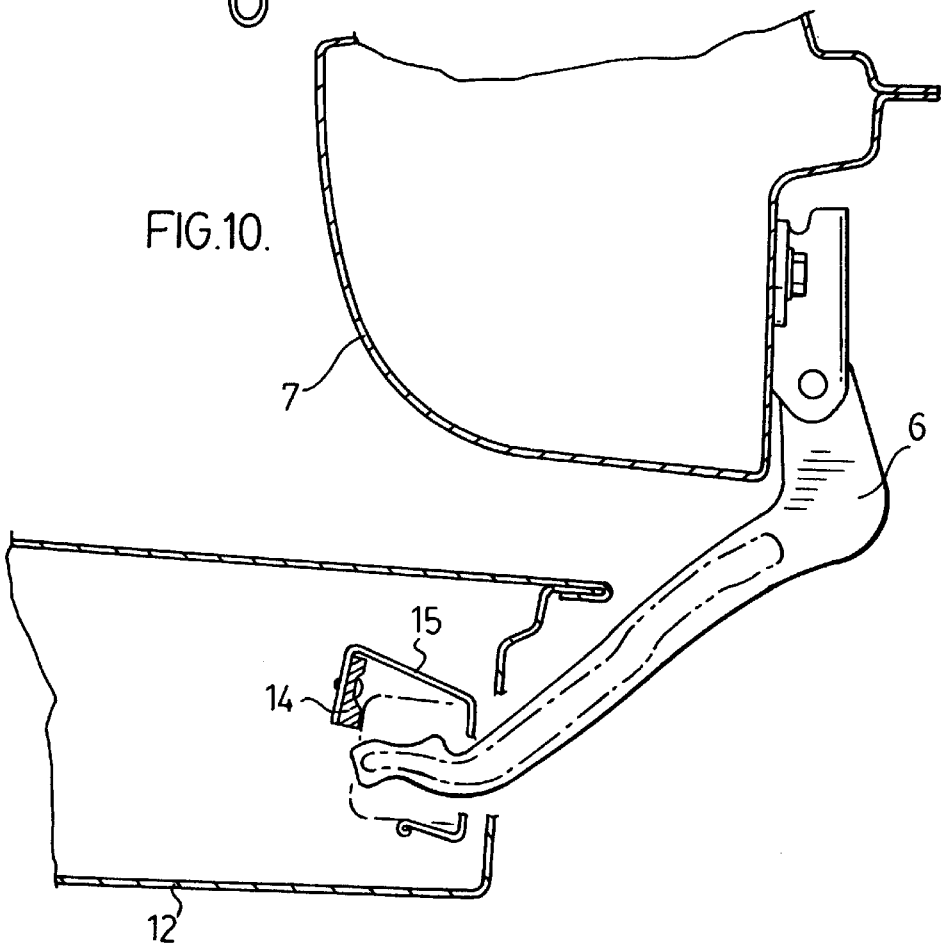
FIG. 10 is a sectional view of the inventive check assembly in the door fully open position (180°).

A preferred embodiment will now be described in relation to the drawings of FIGS. 5 to 10. A door checking arm (6) is permanently pivotally connected to the body structure of a vehicle (7) via a bracket (8) and pivot pin (9). The arm contains a cam profile with detents (10) that dictate the check positions and forces. The arm (6) passes through a housing (11) that is rigidly connected to the vehicular door structure (12). The housing (11) contains an energy storage device consisting of springs, elastomers or similar components known in the prior art and an arm guidance arrangement consisting of balls, rollers, sliders or similar components known in the prior art. The arm (6) contains a hook feature (13) that is configured to interlock with a striker (14) when the door reaches the intermediate stop position. The striker (14) is rigidly mounted to a resilient member (15) that is adapted to constrain the striker (14) from translational motion parallel to the arm (6) centreline but facilitates translational motion perpendicular to the arm (6) centreline. The striker and resilient member are also configured with sufficient structural stiffness and strength to provide adequate resistance to motion between the housing and arm so that the intermediate stop load requirements are met or exceeded. Additionally, the resilient member (15) is geometrically configured to bias the striker into the hook feature so that it automatically engages when the door rotates to the intermediate stop position.

The resilient member (15) can be adapted to be mounted directly to the housing (11) creating a single assembly of housing, resilient member and striker. The striker can be disengaged from the hook feature by manually forcing the resilient member to create translational motion of the striker perpendicular to the arm centreline. An alternative method of striker disengagement is to provide a tab feature (16) incorporated into the resilient member and configured to interface with a sliding pin (17) and bushing (18) assembly, adapted to be mounted to the vehicular door structure (12). The sliding pin (17) is configured to be easily accessible to an operator and when pushed provides adequate force and motion of the resilient member so that the striker translates perpendicular to the arm centreline and disengages from the hook feature. In this way the cargo door intermediate stop feature can be defeated by a single finger actuation of the sliding pin (17) and reengages automatically as the resilient member biases the striker into engagement with the hook feature. Alternatively a cable (19) attached to the striker can also be used to disengage the striker from the hook feature to release the arm from its stop position.

What is claimed is:

1. A door checking and stopping apparatus for an automotive cargo door comprises:

(a) a housing containing an energy storage device and guidance arrangement adapted to be rigidly mounted to a vehicular door;

(b) an arm containing a cam profile with detent positions, permanently pivotally connected to the body structure of the vehicle and configured to interface with the guidance arrangement in the housing;

(c) a striker adapted to be rigidly mounted to a resilient member which is adapted to be rigidly mounted to the vehicular door, said resilient member being configured to constrain the striker from translational motion parallel to the arm centerline but to facilitate translational motion perpendicular to the arm centerline; and (c) a hook feature incorporated into the free end of the arm that is adapted to interlock with the striker, such that the resilient member biases the striker into engagement with the hook feature when the door reaches its predetermined intermediate stop position, providing adequate motion resistance until it is disengaged by overcoming a biasing force generated by the resilient member so that the striker disengages the hook feature.

2. The door checking and stopping apparatus of claim 1, wherein the resilient member is adapted to be rigidly mounted to the housing creating a single assembly of housing, resilient member and striker.

3. The door checking and stopping apparatus of claim 2, wherein the resilient member is provided with a tab feature that interfaces with a sliding pin and bushing assembly, adapted to be mounted to the vehicular door structure, facilitating simple disengagement of the striker from the hook feature.

4. The door checking and stopping apparatus of claim 3, wherein the resilient member is manufactured from high strength spring steel.

5. The door checking and stopping apparatus of claim 3, wherein the resilient member is manufactured from high strength composite material namely carbon fibre or Kevlar®.

6. The door checking and stopping apparatus of claim 2, wherein the resilient member is provided with an attachment to a cable that is terminated externally to the door facilitating simple disengagement of the striker from the hook feature.

7. The door checking and stopping apparatus of claim 2, wherein the resilient member is manufactured from high strength spring steel.

8. The door checking and stopping apparatus of claim 2, wherein the resilient member is manufactured from high strength composite material namely carbon fibre or Kevlar®.

9. The door checking and stopping apparatus of claim 1, wherein the resilient member is provided with a tab feature that interfaces with a sliding pin and bushing assembly, adapted to be mounted to the vehicular door structure, facilitating simple disengagement of the striker from the hook feature.

10. The door checking and stopping apparatus of claim 9, wherein the resilient member is manufactured from high strength spring steel.

11. The door checking and stopping apparatus of claim 9, wherein the resilient member is manufactured from high strength composite material namely carbon fibre or Kevlar®.

12. The door checking and stopping apparatus of claim 1, wherein the resilient member is provided with an attachment to a cable that is terminated externally to the door facilitating simple disengagement of the striker from the hook feature.

13. The door checking and stopping apparatus of claim 1, wherein the resilient member is manufactured from high strength spring steel.

14. The door checking and stopping apparatus of claim 1, wherein the resilient member is manufactured from high strength composite material namely carbon fibre or Kevlar®.

* * * * *